US006209364B1

(12) United States Patent
Collet et al.

(10) Patent No.: US 6,209,364 B1
(45) Date of Patent: Apr. 3, 2001

(54) ESPAGNOLETTE-LOCK FOR A DOOR, FRENCH WINDOW OR THE LIKE

(75) Inventors: Jean-Yves Collet, Saint-Jean-Saverne (FR); Prevot Gérard, Willerwald (FR)

(73) Assignee: Ferco International, Sarrebourg (FR)

( * ) Notice: Subject to any disclaimer, the term of this patent is extended or adjusted under 35 U.S.C. 154(b) by 0 days.

(21) Appl. No.: 09/218,269

(22) Filed: Dec. 21, 1998

(30) Foreign Application Priority Data

Dec. 22, 1997 (FR) ..... 97 16555

(51) Int. Cl.[7] ..... E05B 59/00
(52) U.S. Cl. ..... 70/107; 70/108; 292/39
(58) Field of Search ..... 70/89, 90, 107–110, 70/129, 134; 292/32–36, 39, 40

(56) References Cited

U.S. PATENT DOCUMENTS

| | | | | |
|---|---|---|---|---|
| 4,432,573 | * | 2/1984 | Goldman | 292/39 X |
| 4,476,700 | * | 10/1984 | King | 292/39 X |
| 4,616,864 | * | 10/1986 | Douglas | 292/39 X |
| 4,932,696 | * | 6/1990 | White | 292/39 X |
| 4,986,582 | * | 1/1991 | Sting et al. | 292/39 X |
| 5,253,903 | * | 10/1993 | Daley | 292/39 |
| 5,495,731 | * | 3/1996 | Riznik | 292/39 X |
| 5,524,941 | * | 6/1996 | Fleming | 292/39 X |
| 5,561,994 | * | 10/1996 | Smith et al. | 292/39 X |
| 5,603,534 | * | 2/1997 | Fuller | 292/39 X |
| 5,642,909 | * | 7/1997 | Swan et al. | 292/39 |
| 5,683,122 | * | 11/1997 | Lee | 292/39 |
| 5,722,269 | * | 3/1998 | Simon et al. | 292/39 X |
| 5,794,467 | * | 8/1998 | Justice | 292/39 X |
| 5,810,402 | * | 9/1998 | Armstrong | 292/39 |
| 5,901,989 | * | 5/1999 | Becken et al. | 292/35 |

FOREIGN PATENT DOCUMENTS

| | | | | |
|---|---|---|---|---|
| 4110557 | * | 10/1992 | (DE) | 70/107 |
| 203578 | * | 8/1989 | (JP) | 70/107 |

* cited by examiner

*Primary Examiner*—Suzanne Dino Barrett
(74) *Attorney, Agent, or Firm*—Harrison & Egbert

(57) ABSTRACT

An espagnolette-lock for a door, French window or the like, having, accommodated in a casing (2), a control mechanism (3) including, on the one hand, operating mechanism (4) for at least one operating rod (5, 5A) and, on the other hand, a key-operated member (12) (13) for locking the operating rod or rods (5, 5A) in locking position.

This locking mechanism has in a locking pawl (14) which is designed to be capable of co-operating in a locking position, under the action of the key-operated member (12), with a rack (15) directly or indirectly associated to the operating rod or rods (5, 5A) in order to immobilize the latter in only the unlocking direction.

9 Claims, 3 Drawing Sheets

FIG. 1
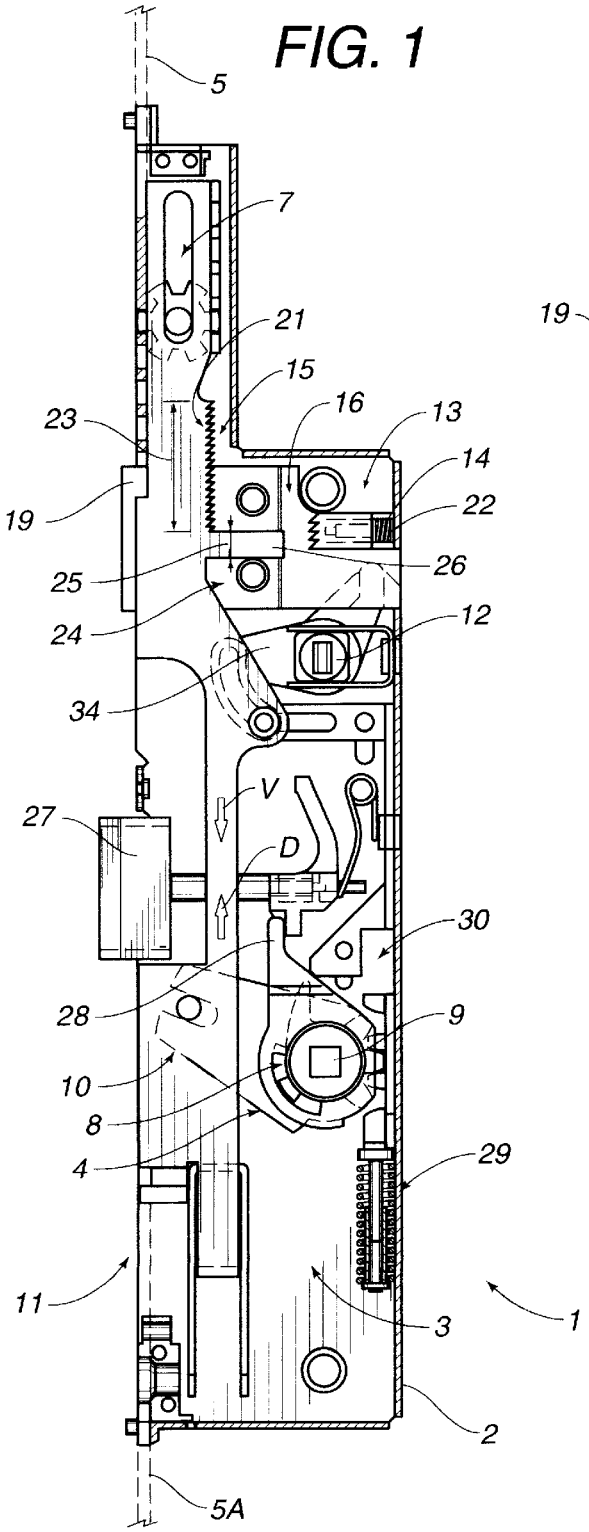
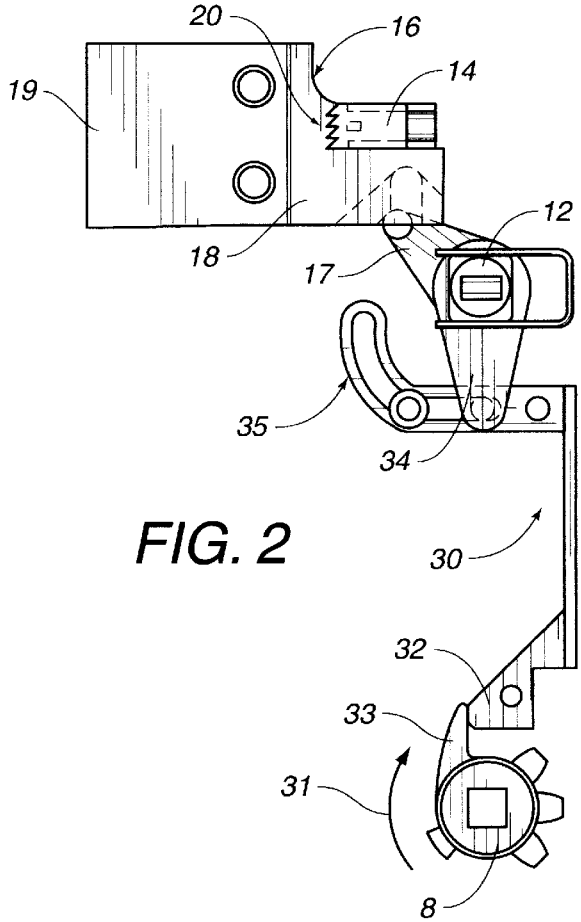
FIG. 2

ESPAGNOLETTE-LOCK FOR A DOOR, FRENCH WINDOW OR THE LIKE

BACKGROUND OF THE INVENTION (1) Field of the Invention

The invention relates to an espagnolette-lock for a door, French window or the like, comprising, accommodated in a casing, a control mechanism including, on the one hand, manual and/or automatic operating means for at least one operating rod capable of acting on one or several locking organs aimed at co-operating with one or several keepers and, on the other hand, a key-operated member for controlling a dead bolt and means for locking the operating rod or rods in a locking position.

This invention will find its application in the field of building iron-mongery and in particular relates to espagnolettes-locks.

(2) Description of the Prior Art

Of course, a number of espagnolettes-locks meeting the above description are already known.

Thus, such an espagnolette-lock for a door, French window or the like includes a casing fitted on the leaf and receiving a control mechanism on which the user can act through a key-operated member and often a control handle or knob.

Such a control mechanism therefore includes manual and/or automatic operating means for at least one operating rod extending above and/or below the casing and capable of acting on one or several locking organs cooperative with keepers accordingly located on the sash-frame of the door or wndow. In this respect, the operating rods of such an espagnolette-lock can be uni- or bidirectional, i.e. the operating rod extending above and the one arranged below the casing can move in the same direction in order to pass from the unlocking position into the locking position, as well as their motions can be reversed under the action of the control mechanism.

As regards the operating means for these operating rods, they usually consist in a control handle or knob acting on the operating square of a tumbler which co-operates, through either a toothing or a control pin, either directly or through a support, on the operating rod or rods. One should observe that, in a known way, such a control handle or knob can also act, through one and the same stepped tumbler, on a spring-bolt elastically restored into the locking position. In this respect, it is also usual to cause the tumbler to co-operate with springy restoring means so as to systematically retore the control handle or knob into its initial postion upon the locking or unlocking operation of the operating rod or rods or of the spring-bolt.

In order to increase the safety of such espagnolettes-locks and, in particular, to avoid the operating rod or rods from being pushed back from their locking position into their unlocked position by a direct action on the locking organs controlled by this or these operating rods. Such an espagnolette-lock in addition includes means for locking the latter in a locked position, such locking means being controlled by the key-operated member.

In this respect, these locking means are often formed by either a dead bolt capable of being controlled by this key-operated member or by an organ directly associated to this dead bolt.

Anyway, the latter is, in any case, nothing else than a locking pin which, under the action of a key-operated member, is capable of positioning itself into a slot or a cut-out provided for in the support or in an operating rod. As a matter of fact, this co-operation is possible only when the operating rod or rods are brought in their fully locked position, which leads to positioning the cut-out or the slot in the support or in the rod in front of the locking pin.

Finally, it is absolutely necessary for the operating rod or rods to have been previously properly locked, for otherwise the above-mentioned locking means cannot be activated. It often occurs that this operation cannot be fully completed because of an improper adjustment or due to wear of the keepers, so that the locking means can, in turn, not be activated.

In this context, the user has no other way of locking the door when at home than by operating the key-operated member.

In this respect, one should also observe that there presently exist espagnolettes-bolts which are often referred to as semi-automatic espagnolettes-bolts and including springy means for automatically restoring the operating rods into a locking position as soon as the door or window is closed against the sash-frame. The unlocking is achieved manually, like before, through an action on a control handle or knob, which furthermore results into resetting the springy restoring means.

Either these springy restoring means have a high stiffness coefficient to systematically and completely bring the operating rods into their locking position, which results in high operating noise, in addition to the fact that the unlocking operation is made more difficult. Alternatively, these springy restoring means are made just sufficient for the function they have to carry out as long. As a matter of fact, in the opposite case such springy restoring means often bring the operating rods in an intermediate position between their locking position and their unlocking position. The control handle through which the unlocking is carried out can, under such circumstances, be used to manually bring these operating rods into the final locking position. Finally, the user will complete this manual step only when he wants to make sure his door or window is perfectly locked, when he leaves his home for an extended period of time. In other situations, he may perfectly be satisfied with a locking resulting from a partial insertion into the keepers of the locking organs controlled by the operating rod or rods.

Now, it is obvious that, when providing such semi-automatic espagnolettes-locks with locking means for the operating rod or rods corresponding to a design as described above, the user will almost systematically have to act on the operating rod or rods, through the control handle, to make sure they are effectively in their fully locked position, before controlling the key-operated member.

SUMMARY OF THE INVENTION

The present this invention is aimed at providing a solution for the above-mentioned problem through an espagnolette-lock authorizing a locking, and therefore an immobilization, of the operating rods against an action tending to bring them into a locking position, regardless of the position taken by these operating rods between the unlocking and the locking position. Finally, this invention provides for locking resulting from the dead bolt, thus of increasing the safety, even with a slight insertion of the locking organs in their keepers.

To this end, the invention relates to an espagnolette-lock for a door, French window or the like, comprising, accommodated in a casing, a control mechanism including, manual and/or automatic operating means for at least one operating rod capable of acting on one or several locking organs cooperative with one or several keepers and, a key-operated member for controlling a dead bolt and means for locking the operating rod or rods in locking position, characterized in that the locking means for the operating rod or rods has a locking pawl which is capable of co-operating in locking position, under the action of the key-operated member, with a rack directly or indirectly associated to the operating rod or rods in order to immobilize the latter only in the unlocking direction.

This espagnolette-lock preferably includes, in addition, means capable of impeding the locking from co-operating with the operating rod or rods over a travel distance which, starting from the unlocking position of the latter, is at most equal to the backlash remaining between the locking organ or organs associated to this or these operating rods and the keeper or keepers which they cooperate with.

Thus and by way of an example, in the event the ends of these operating rods are protruding at the upper portion and/or the lower portion of the leaf, so as to co-operate with keepers accordingly arranged on the sash-frame, this travel distance will be at most equal to the backlash existing between the fillisters of the door.

In addition it is usual to provide such espagnolettes-locks with a spring-bolt the control of which is performed through a tumbler actuatable by means of a control handle or knob often forming the manual operating means for the operating rod or rods. As a matter of fact, according to the invention, this espagnolette-lock includes, in combination with the means for locking the operating rod or rods in locking position as described above, means for immobilizing in rotation the tumbler actuatable by means of the control handle or knob, in the direction of unlocking of the spring-bolt. These immobilizing means are actuated through the key-operated member at the same time as the means for locking the operating rod or rods in a locking position.

Through this invention a user is able to safely lock its door or French windows by means of an espagnolette-lock the operating rod or rods of which have not been fully locked previously.

As explained above, this allows one to advantageously cope with the problem of the framework of espagnolettes-locks provided with semiautomatic operating means for the operating rod or rods. This in addition allows this user to lock its door or window in the event its espagnolette-locks malfunctions.

Further aims and advantages of this invention will become clear when reading the following description which relates to an embodiment which is given only by way of an indication and a non-exhaustive example.

This description will be better understood when referring to the attached drawings.

BRIEF DESCRIPTION OF THE DRAWINGS

FIG. 1 is a schematic elevational view of an espagnolette-lock according to this invention;

FIG. 2 is a schematic view of the means for immobilizing in rotation the tumbler ensuring the control of the spring-bolt, this when these immobilizing means are brought into the active position under the action of the key-operated member ensuring, furthermore, the control of a dead bolt to which are associated the means for locking the operating rod or rods in locking position, these locking means being in the shape of a pawl;

DESCRIPTION OF THE PREFERRED EMBODIMENTS

Figure 3:
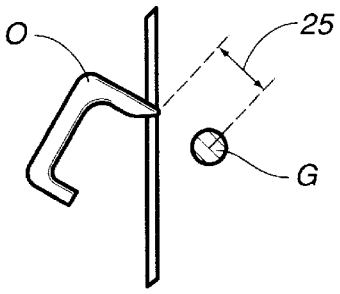
FIGS. 3 through 5 schematically show the three positions adopted by a locking organ in the shape of a web, from the unlocked position to the locking position, passing through the position in which the web enters into co-operation with a hooking-in organ which serves as a keeper for the latter.
Figure 4:
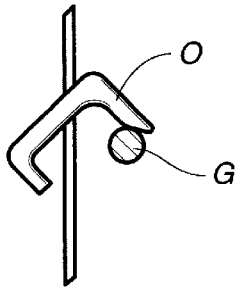
Figure 5:
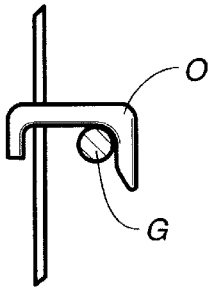
Figure 6:
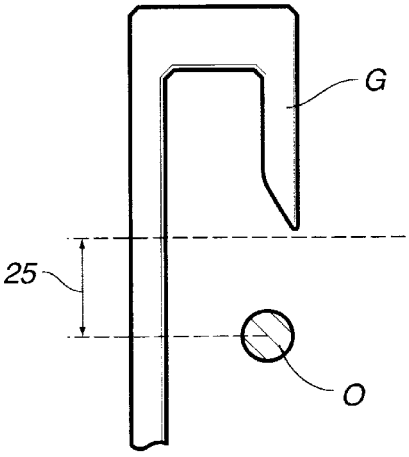
FIGS. 6 through 8 correspond to illustrations similar to FIGS. 3 through 5 in the case of a locking organ in the shape of a railwheel or a roller.
Figure 7:
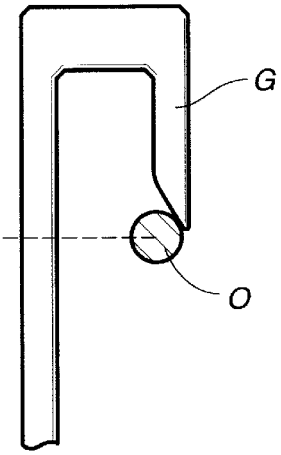
Figure 8:
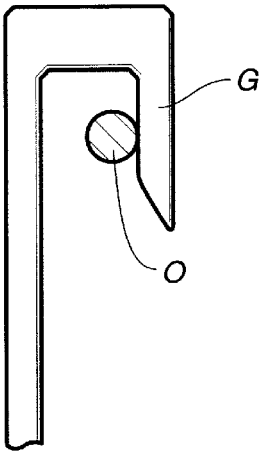
Figure 9:
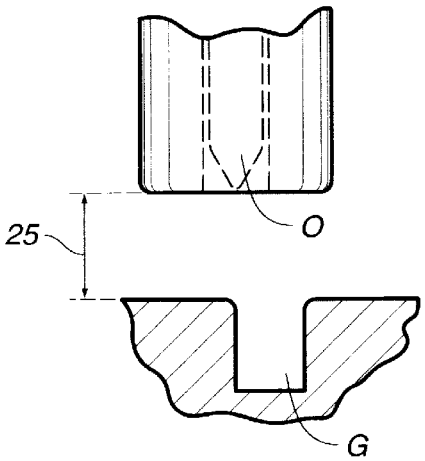
FIGS. 9 through 11 represent, in the same situations as shown in FIGS. 3 through 5 or in FIGS. 6 through 8, a locking organ defined by the free end of an operating rod.
Figure 10:
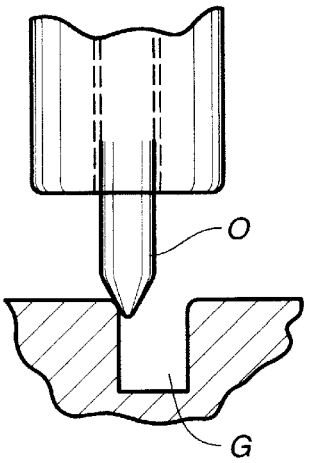
Figure 11:
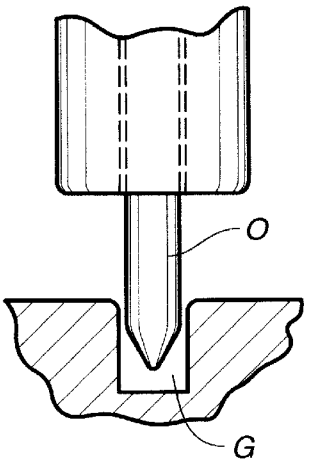

As shown in FIGS. 1 and 2 of the attached drawings, this invention relates, in particular, to an espagnolette-lock 1 for a door, French window or the like, comprising, accommodated in a casing 2, a control mechanism 3.

The control mechanism 3 mainly includes manual and/or automatic operating means 4 for at least one operating rod 5, 5A extending above and/or below the casing 2.

The transmission to the operating rods 5, 5A of the motion imparted through the control mechanism 3 is achieved by means of a support 6 accommodated in the casing 2. In this respect, one should observe that, such operating rods 5, 5A have to move in one and the same direction, between their locking position and their unlocking position, as well as their displacement can be in opposite directions. In this latter case, the support 6 co-operates, as shown in FIG. 1, with a motion inverter 7, known in the prior art, which allows to impart to one operating rod 5 a displacement in the opposite direction with respect to that imparted to the other operating rod 5A through the control mechanism 3.

As regards the operating means 4, these have been shown, in FIG. 1, in the shape of a manual embodiment and has a tumbler 8 provided with a recess 9 for receiving an actuating square corresponding to a control handle or knob, not shown. In particular, this tumbler 8 co-operates, through a driving organ 10, here in the shape of a fork, with the support 6, so that, under the action exerted by the user on the tumbler 8 through the control handle or knob, this results into the displacement of the support 6, hence of the operating rods 5, 5A for either locking or the unlocking.

Such operating rods 5, 5A are, as the case may be, capable of acting on one or several locking organs cooperative with keepers accordingly arranged on the sash-frame, and/or their free end can, in locking position, be protruding with respect to the upper or lower end of the front stile of the leaf, so as to co-operate with keepers which are also placed accordingly at the level of the rail of the sash-frame or of the threshold of the door.

In the embodiment shown in FIG. 1, these operating rods 5, 5A are substantially in the extension of the front edge 11 of the casing 2 so that they move behind a face-plate generally built-in at the level of the front edge of the leaf. These operating rods 5, 5A can also be located at any location in the thickness of the leaf. Under these circumstances, the support 6 acts, at its ends, on transmission parts of an adequate configuration capable of transmitting to said operating rods 5, 5A the motion imparted to this support 6.

According to the invention, this espagnolette-lock 1 in addition receives a key-operated member 12, such as a barrel, for controlling means 13 for locking the operating rod or rods 5, 5A in locking position. According to a peculiar feature of this invention, these locking means 13 consist in a locking pawl 14 which is designed so as to be capable of co-operating, in locking position, under the action of the key-operated member 12, with a rack 15 directly or indirectly associated to the operating rods 5, 5A, in order to immobilize the latter only in the unlocking direction.

As can be seen in FIG. 1, the locking pawl 14 is connected to a support 16 slidingly fitted in the casing 2, transversally, hence perpendicularly, to the direction of displacement of the operating rod or rods 5, 5A or of the support 6. The control of the displacement of this support 16 being performed through a driving pawl 17 controlled by the key-operated member 12.

According to the preferred embodiment shown in this FIG. 1, the support 16 of the locking pawl 14 is defined by the body 18 of a dead lock 19 which, in locking position, is capable of being protruding with respect to the front edge of the leaf so as to co-operate with a keeper accordingly arranged on the sash-frame while, in unlocked position, this dead bolt 19 withdraws inside the casing 2.

In its locking position, this dead bolt 19 causes the locking pawl 14 to co-operate with the rack 15 which is connected to the support 6. This locking pawl 14 includes a teeth 20 which thus co-operates with the toothing 21 of this rack 15, these toothings 20, 21 having a dissymmetrical shape defined so that:

by imparting, through actuating means 4, to the operating rods 5, 5A, thus to the support 6, a displacement in the locking direction, designated by arrow V, these toothings 20, 21 act on each other as cams, causing the withdrawal of the toothing 20 from the pawl 14 against the action of springy restoring means 22;

during an attempt to move this or these operating rods 5, 5A, thus the support 6, in the unlocking direction (arrow D) by causing these teeth 20, 21, because of their profile, to act as stops, the support 6 is impeded from moving in such an unlocking direction.

The length 23 of the rack 15 may be determined so that the locking pawl 14 is capable of co-operating with this rack 15 under the action of the key-operated member 12, regardless of the position adopted by the support 6 and, accordingly, by the operating rods 5, 5A.

Therefore, such locking means 13 can be actuated while the locking by means of these operating rods 5, 5A is only partially ensured. One should in particular observe that, in this case, the dead bolt 19 can freely be brought into its locking position, so as to safely lock, at least partially, the door or window provided with the espagnolette-lock 1.

As can be seen in FIG. 1, the espagnolette-lock 1 can be provided with means 24 designed so as to be capable of impeding this cooperation between the locking pawl 14 and the rack 15 of the support 6 as long as there has not been at least an attempt to lock the operating rods 5, 5A, for otherwise it could happen that the user inadvertently fails to safely lock its door or window through locking organs depending on this or these operating rods 5, 5A.

According to the invention, these means 24 are designed so as to be capable of impeding the co-operation between the locking pawl 14 and the rack 15 over a travel distance 25 corresponding at most to the backlash existing between the location at which normally enter into cooperation with the keeper or keepers the locking organs and the latter when the operating rod or rods 5, 5A are in an unlocked position.

In FIGS. 3 through 5, 6 through 8 and 9 through 11, locking organs, designated by 0, have been shown in various embodiments, respectively in the shape of a web, a railwheel or roller, or in the shape of an end of an operating rod. These locking organs have each been shown in their unlocking and locking position and in the position in which this locking organ 0 enters into cooperation with the keeper G on the sash-frame. In each of these cases, the backlash or the travel distance has been designated by 25.

By way of an example, when the locking organ 0 capable of being actuated by an operating rod is defined by the free end of the latter, which is capable of being protruding with respect to the upper or lower edge of the leaf in order to co-operate with a keeper G accordingly arranged on the sash-frame or of the threshold of the door or the like, the travel distance 25 will be substantially equal to the backlash remaining between the fillisters of the leaf and the sash-frame or the threshold of the door.

In substance, the aforementioned means 24 are comprised of a stop 26 integral with the support 6 and positioning itself ahead of the locking pawl 14 when the operating rod or rods 5, 5A are in unlocked position, thus impeding their immobilization through this locking pawl 14, the height of this stop 26 depending on the aforementioned travel distance 25.

Finally, such an espagnolette-lock 1 can also be provided with a spring-lock 27 with elastic restoration into a locking position, on this spring-bolt 27 being capable of acting on a control pin 28 associated to a tumbler 8 which, in a preferred embodiment, is the one through which the user can act on the support 6, thus on the operating rods 5, 5A. Such a tumbler 8 is, under such circumstances, provided with several crowns which allow it to selectively and/or simultaneously act on this spring-bolt 27 or these operating rods 5, 5A during the control in rotation under the action exerted by the user on a control handle or knob designed so as to be capable of acting on the tumbler 8.

As shown in FIG. 1, this tumbler 8 may also be subjected to springy restoring means 29 the function of which is to systematically restore the control handle or knob into a well-defined resting position.

This espagnolette or espagnolette-lock 1 according to the invention advantageously includes means 30 for immobilizing the tumbler 8 in rotation at least in the direction 31 corresponding to a control to unlock, as the case may be, the spring-bolt 27 and/or the operating rod or rods 5, 5A, these means being actuated by the key-operated member 12 simultaneously with the locking means 13.

In substance, such means 30 for immobilizing in rotation has a locking foot 32 which, in active position, is capable of co-operating with a tooth forming a stop 33 on the tumbler 8 to immobilize the same in rotation in the aforementioned direction 31. This locking foot 32 is subjected to a translation motion between an active position and a non-active position under the action of a driving pawl 34 capable of being controlled by the key-operated member 12.

In this respect, this locking foot 32 is provided with a transmission organ defined so as to be capable of converting a rotational motion imparted to the driving pawl 34 through the key-operated member 12 into a linear displacement between an active position and a non-active position of the locking foot 32.

Figure 12:
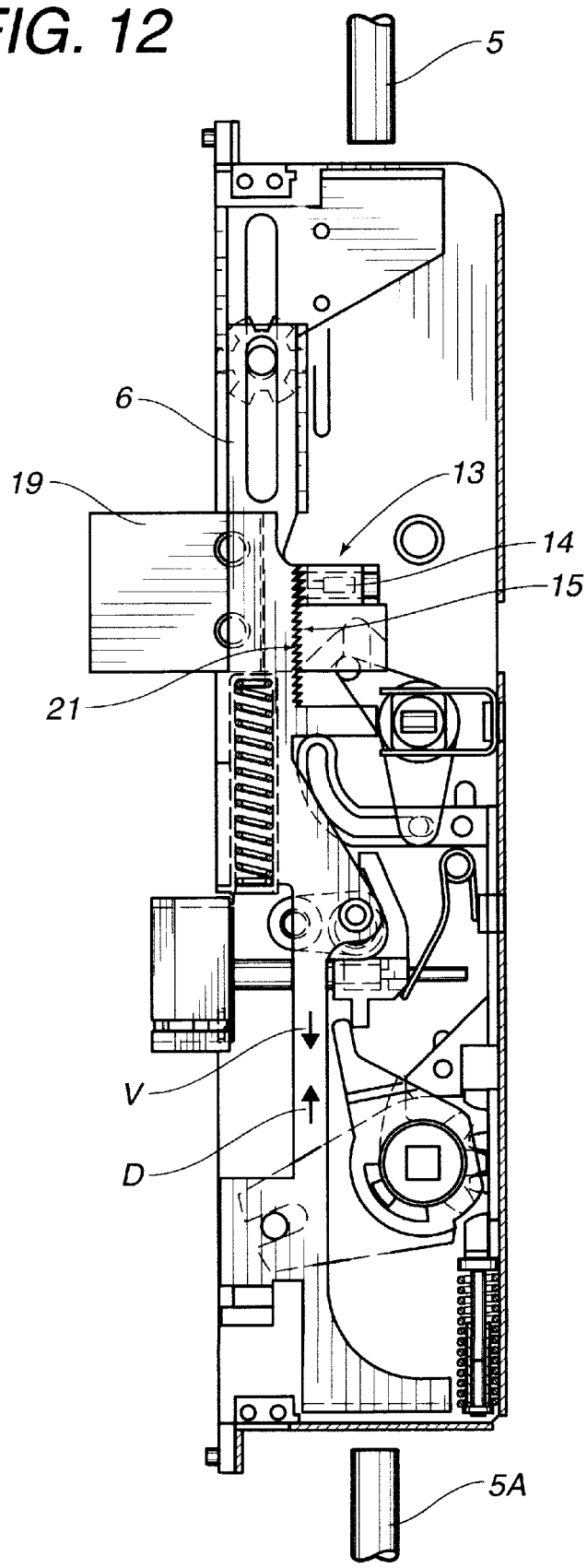
FIG. 12 shows the espagnolette-locking of the present invention, particularly illustrating how the pawl engages the rod teeth.

One should observe that, though FIG. 1 of the attached drawing shows an embodiment of this transmission organ 35, this invention is in no way limited to it and other embodiments can of course be contemplated. FIG. 1 shows the various parts of the control mechanism in a position corresponding to the unlocking position. FIG. 12 shows the same mechanism in a locked position showing, in particular, the cooperation between the pawl 14 and the teeth of rack 15. In this locked position, the pawl 14, (integral with the dead lock 19) is moved forward and engages the rack 15 associated with support 6 connected to operating rods 5, 5A. This support 6 is shown as lowered in this locking position (as shown by arrow V in FIG. 1). In this locking position, the pawl 14 prevents the unlocking of the operating rods 5, 5A while permitting further displacement in the locking direction.

Finally, as results from the preceding description, an espagnolette-lock according to this invention not only makes possible the locking of a door or window even when the operating rod or rods 5, 5A are not fully brought in their locking position, but in addition also offers a degree of safety which, even under those circumstances, remains particularly high.

The present invention will be applicable in the field of semi-automatic espagnolettes-locks including means for elastically restoring the operating rod or rods 5, 5A into locking position.

What is claimed is:

1. An espagnolette lock comprising:

a casing;

a control means positioned within said casing;

at least one operating rod interconnected to said control means, said control means for moving said operating rod relative to said casing between a locked position and an unlocked position;

a key-operated member received in said casing, said key-operated member having a locking means interactive with said operating rod, said locking means for locking said operating rod in said locked position, said locking means comprising a locking pawl and a rack, said rack being connected to said operating rod, said locking means being actuatable by said key-operated member so that said locking pawl engages said rack to immobilize said operating rod from movement in a single direction from said locked position toward said unlocked position, said locking pawl having teeth formed thereon, said rack having teeth formed thereon, said teeth of said locking pawl being cooperative with said teeth of said rack, said teeth of said locking pawl and said teeth of said rack having a dissymmetrical shape.

2. The lock of claim 1, said control means comprising:

a support positioned in said casing, said rack being affixed onto said support, said control means for moving said support so as to correspondingly move said operating rod between said locked position and said unlocked position.

3. The lock of claim 1, said locking pawl being connected to a support member slidably received within said casing, said support member slidable in a direction transverse to said operating rod, said key-operated member having a driving pin pivotally connected to said support member such that a rotation of said key-operated member causes a sliding movement of said support member.

4. The lock of claim 3, said casing having a front portion, said locking means further comprising a dead bolt connected to said support member, said dead bolt movable through said front portion with said sliding movement of said support member.

5. The lock of claim 1, said rack having a length suitable such that said locking pawl is engageable with said rack regardless of a position of said operating rod between said locked position and said unlocked position.

6. The lock of claim 1, further comprising:

impeding means positioned within said casing and interactive with said locking means, said impeding means for preventing movement of said locking pawl and said rack beyond a predetermined travel distance.

7. The lock of claim 6, said impeding means comprising:

a stop positioned in front of said locking pawl when said operating rod is in said unlocked position, said stop having a dimension corresponding to said predetermined travel distance.

8. The lock of claim 1, said control means comprising:

a spring bolt;

a tumbler controllably connected to said spring bolt, said spring bolt movable between a locking position and an unlocking position, said spring bolt being elastically urged toward said locking position; and means for immobilizing said tumbler to prevent a movement of said spring bolt from said locking position toward said unlocking position, said means for immobilizing being cooperative with said key-operated member.

9. The lock of claim 8, said tumbler being interconnected to said operating rod such that a rotation of said tumbler causes a corresponding movement of said operating rod between said locked position and said unlocked position.

* * * * *